US006302610B2

(12) United States Patent
Mito et al.

(10) Patent No.: US 6,302,610 B2
(45) Date of Patent: Oct. 16, 2001

(54) DIRECT-FEED TYPE WRITING IMPLEMENT

(75) Inventors: Yosuke Mito, Yokohama; Kazuhiko Furukawa, Kouza-gun, both of (JP)

(73) Assignee: Mitsubishi Pencil Kabushiki Kaisha, Shinagawa-Ku (JP)

( * ) Notice: Subject to any disclaimer, the term of this patent is extended or adjusted under 35 U.S.C. 154(b) by 0 days.

(21) Appl. No.: 09/738,596

(22) Filed: Dec. 15, 2000

(30) Foreign Application Priority Data

Dec. 16, 1999 (JP) ..... 11-357278

(51) Int. Cl.[7] ..... B43K 5/18

(52) U.S. Cl. ..... 401/198; 401/223; 401/225; 401/227; 401/229; 401/230

(58) Field of Search ..... 401/198, 223, 401/224, 225, 227, 228, 229, 230, 241

(56) References Cited

U.S. PATENT DOCUMENTS 2,921,558 * 1/1960 Von Platen ..... 401/224
3,951,555 * 4/1976 Wittnebert et al. ..... 401/199 X
4,509,876 * 4/1985 Hori ..... 401/225 X
5,906,446 * 5/1999 McCulloch et al. ..... 401/198 X

FOREIGN PATENT DOCUMENTS 227886 8/1992 (JP) .

* cited by examiner

*Primary Examiner*—Steven O. Douglas
*Assistant Examiner*—Kathleen J. Prunner
(74) *Attorney, Agent, or Firm*—Darby & Darby

(57) ABSTRACT

A direct-feed type writing implement includes: a point assembly having a writing point at the tip thereof; an ink tank directly storing a relatively low viscosity ink having a viscosity of 2 to 100 mPa.S at room temperature; an ink collector made up of a multiple number of vanes for adjusting the internal pressure of the ink tank by utilizing capillarity; a feeder including a center core, for feeding ink from the ink tank to the writing point; an ink absorber connected to the center core as the ink feeder; and a duct pipe connecting the ink collector and the ink tank; and preferably, ink is supplied to the center core as the ink feeder only through the ink absorber and the duct pipe.

29 Claims, 12 Drawing Sheets

DIRECT-FEED TYPE WRITING IMPLEMENT

BACKGROUND OF THE INVENTION (1) Field of the Invention

The present invention relates to a direct-feed type writing implement.

(2) Description of the Prior Art

Conventional direct-feed type writing implements which use so-called raw ink, i.e., liquid ink, are known to employ an ink collector making use of capillary action, e.g., of a vane-like regulator or a fiber bundle for temporal retention of ink, in order to prevent ink leakage due to expansion of the air inside the ink tank accompanying change in ambient conditions such as reduction in pressure and/or increase in temperature.

In a writing implement using the ink collector, in order to positively prevent forward leakage of ink from the writing point side, the size of the ink collector is designed based on the maximum expansion, estimated from the ink tank volume. Therefore, the design of the size of the ink collector depends on the size of the ink tank. That is, the larger the ink tank, the greater the ink collector needs to be.

However, forming a larger ink collector means more cost. There is another drawback in that making the ink collector larger in diameter results in the loss of stylish appearance. Alternatively, if the ink collector is long, the feeder means such as a center core or the like which penetrates through the ink collector and leads ink to the writing portion becomes long, so that the long collector configuration produces disadvantages as to forward leakage since the head of ink acts on the writing portion.

In general, it is well known that the ink retention volume of the ink collector is set at 10 to 30% of the ink tank volume. However, there have been demands for the reduction of the size of the ink collector while keeping the ink tank size, or for enlarging the size of the ink tank while keeping the ink collector as is.

Conventionally, a configuration using an ink absorber provided in the ink tank is disclosed in Japanese Patent Application Laid-Open Hei 4 No. 227886. As shown in FIGS.1 to 3, this configuration includes a capillary liquid retainer 215, i.e., the ink absorber as a center core for feeding ink to the writing tip 212 and an air supply pipe 213. This conventional configuration is an applicator 210 wherein a liquid suctioning device 216 is isolated at a position when the writing point is set approximately downwards. Actually, when the writing point is oriented downwards as in normal writing, no ink is supplied to liquid suctioning device 216, hence the ink reserved in liquid suctioning device 216 is the only ink supply for writing, resulting in a short writing distance.

A further description about the prior art disclosed in Japanese Patent Application Laid-Open Hei 4 No. 227886 will be made with reference to FIGS. 1 to 3. In applicator 210, air supply pipe 213 allows a liquid container 211 to be filled with air equal in volume to that of outflow of liquid 217 and also is to prevent liquid 217 from flowing through the opening formed in air supply pipe 213 and directing the liquid into air 214, in cooperation with a space 227 or a capillary medium 226 provided in the space 227. This means that no ink will enter air supply pipe 213 and will be supplied to the writing portion and ink supply to the writing portion is provided only by liquid 217 stored in capillary liquid retainer 215. Therefore, in this conventional case, the ink reserved in the capillary liquid retainer is the only ink supply, resulting in a short writing distance, as described above.

Japanese Patent Application Laid-Open Hei 4 No. 227886 also discloses a prior art configuration shown in FIG. 2 in which liquid 217 is stored in a contractile tube 224 accommodated in an inner space 225 of liquid container 211 so as to fill almost the entire inner space 225 with liquid 217. This means that if no contractile tube is used, the entire inner space 225 cannot be filled up with liquid 217, i.e., ink. The fact that liquid 217 cannot fill the entire inner space but can only fill up to about half, is obvious in FIG. 1 and in another embodiment shown in FIG. 3. Therefore, in order to fill the whole container of the ink tank with ink, the above-mentioned tube is a must. Therefore, configurations without such a tube have the drawback in that inner space 225 or the entire ink tank cannot be filled up with ink.

On the other hand, in the case where inner space 225 or the ink tank using such a tube is filled with ink, the following problem occurs. When the tube is formed of rubber or the like having elasticity, the pressure due to contraction of the rubber or the like is continuously applied to liquid 217 or the ink. This situation is the same when the writing point is set upwards. In the conventional configuration shown in FIG. 2, disclosed in Japanese Patent Application Laid-Open Hei 4 No. 227886, since liquid 217 is able to enter capillary liquid retainer 215 due to the function of a valve means 220 when the writing point is set upwards, the ink under pressure infiltrates capillary liquid retainer 215, causing leakage from the tip, designated at 212. When the tube is formed of a non-elastic material, no pressure from elasticity acts on the ink. Therefore, with consumption of liquid 217, air will enter tube 224 forming a space in order to compensate for the volume of ink consumed. If such a space is formed and if the space expands due to increase in temperature, reduction in pressure or any other reason, liquid 217 is able to enter capillary liquid retainer 215 when tip 212 or the writing point is set upwards. Therefore, also in this case, ink will reach tip 212 via capillary liquid retainer 215 and finally the ink or liquid 217 will leak from the tip. It may be considered that this ink leakage problem occurring when the writing point or tip 212 is put upwards is solved by providing a vent near tip 212. However, when tip 212 is put downwards, since from the structure of the design, neither ink nor air will enter capillary liquid retainer 215 through valve means 220, if the air expands due to increase in temperature and/or reduction in pressure, ink will leak from the vent provided near tip 212. Thus, from a practical view point, it is difficult for the structure using the tube disclosed in Japanese Patent Application Laid-Open Hei 4 No. 227886 to provide a writing implement in which the entire ink tank can be filled up with ink.

Thus, the invention disclosed in Japanese Patent Application Laid-Open Hei 4 No. 227886, by any means, faces difficulties in filling the ink tank with ink, and has the drawback in that the entire ink tank cannot be filled up with ink.

The drawings related to the examples shown in Japanese Patent Application Laid-Open Hei 4 No. 227886, illustrate configurations in that the opening formed in air supply pipe 213 is not dipped in ink and is continuously open to the atmosphere when the writing point is set downwards. In the case as above where inner space 225 is put in communication with the atmosphere, if the pen has a low ink retention as when capillary liquid retainer 215 has a high porosity, there occurs a drawback that ink will leak forwards from the writing point. To deal with this, if a capillary liquid retainer with a low porosity is used to prevent forward leakage, the ink retention becomes high, causing difficulties in ejecting ink from the writing point, hence degrading ink supply during writing as a writing implement whilst producing drawn lines of low-density.

SUMMARY OF THE INVENTION

The present invention is to solve the above problems. Particularly, the object of the present invention is to provide a direct-feed type writing implement having an ink tank equal in volume to that of the conventional configuration but using an ink collector smaller than that of the conventional configuration, or to provide a direct-feed type writing implement having a ink collector equal in size to that of the conventional configuration but being able to store a greater amount of ink than the conventional configuration.

It is another object of the present invention to provide a direct-feed type writing implement free from the problems with the conventional configuration having an ink absorber provided inside the ink tank, that is, short writing distance, incapability of filling the entire ink tank, and forward leakage accompanying the communication with the atmosphere via the opening of the air supply pipe.

It is still another object of the present invention to provide a direct-feed type writing implement in which ink can be supplied continuously when the ink exists above the duct pipe end with the writing point set downwards, and ink can be supplied by the ink held in the ink absorber and the duct pipe when the ink surface exists below the duct pipe end with the writing point set downwards, to thereby make the writing distance longer than existing configurations.

In order to achieve the above objects, the present invention is configured as follows:

In accordance with the first aspect of the present invention, a direct-feed type writing implement includes:

a point assembly having a writing point at the tip thereof;

an ink tank directly storing a relatively low viscosity ink having a viscosity of 2 to 100 mPa.S at room temperature;

an ink collector for adjusting the internal pressure in the ink tank by utilizing capillarity;

a feeder means including a center core, for feeding ink from the ink tank to the writing point;

an ink absorber connected to the center core as the ink feeder means; and a duct pipe connecting the ink collector and the ink tank.

In accordance with the second aspect of the present invention, a direct-feed type writing implement includes:

a point assembly having a writing point at the tip thereof;

an ink tank directly storing a relatively low viscosity ink having a viscosity of 2 to 100 mPa.S at room temperature;

an ink collector for adjusting the internal pressure of the ink tank by utilizing capillarity;

a feeder means including a center core, for feeding ink from the ink tank to the writing point;

an ink absorber connected to the center core as the ink feeder means; and a duct pipe connecting the ink collector and the ink tank, and is characterized in that ink is supplied to the center core as the ink feeder means only through the ink absorber and the duct pipe.

In accordance with the third aspect of the present invention, the direct-feed type writing Implement having the above first or second feature is characterized in that the duct pipe is formed with an ink storage portion.

In accordance with the fourth aspect of the present invention, the direct-feed type writing implement having the above first or second feature is characterized in that the ink absorber is arranged inside the duct pipe.

In accordance with the fifth aspect of the present invention, the direct-feed type writing implement having the above first or second feature is characterized in that the periphery of the ink absorber is covered by a non-absorbable skin with its front and rear ends open.

In accordance with the sixth aspect of the present invention, the direct-feed type writing implement having the above first or second feature is characterized in that the ink absorber Is disposed at least close to the ink tank bottom.

In accordance with the seventh aspect of the present invention, the direct-feed type writing implement having the above first or second feature is characterized in that the duct pipe has a length approximately equal to or greater than half the full length of the ink tank.

In accordance with the eighth aspect of the present invention, the direct-feed type writing implement having the above first or second feature is characterized in that the ink collector is provided with an ink channel forming an air-liquid exchanger, and the ink feeder portion for leading ink to the ink channel is formed on the ink collector end face on the ink tank side.

In accordance with the ninth aspect of the present invention, the direct-feed type writing implement having the above first or second feature is characterized in that a fine hole is formed in the communication passage for creating communication between the ink collector for adjusting the internal pressure in the ink tank by utilizing capillarity and the ink feeder means including a center core.

In accordance with the tenth aspect of the present invention, the direct-feed type writing implement having the above first or second feature is characterized in that, when the ink surface is above the duct pipe end portion with the writing point set downwards, the expansion of the air space when the temperature of the ink tank is increased from room temperature to about 50° C., is equal to or lower than the ink retention volume of the ink collector.

In accordance with the eleventh aspect of the present invention, the direct-feed type writing implement having the above first or second feature is characterized in that, when the ink surface is above the duct pipe end with the writing point set upwards, the expansion of the air space when the temperature of the ink tank is increased from room temperature to about 50° C., is equal to or lower than the sum of the ink retention volume of the ink collector and the volume of the clearance formed between the barrel wall and the ink collector.

In accordance with the twelfth aspect of the present invention, the direct-feed type writing implement having the above first or second feature is characterized in that the ink retention volume of the duct pipe is equal to or lower than the ink retention volume of the ink collector.

In accordance with the thirteenth aspect of the present invention, the direct-feed type writing implement having the above first or second feature is characterized in that the total ink retention volume of the duct pipe and the ink absorber is equal to or lower than the ink retention volume of the ink collector.

In accordance with the fourteenth aspect of the present invention, the direct-feed type writing implement having the above first or second feature is characterized in that the ink tank is charged with ink until almost full.

In accordance with the fifteenth aspect of the present invention, the direct-feed type writing implement having the above first or second feature is characterized in that the end portion of the duct pipe is beveled.

In accordance with the sixteenth aspect of the present invention, a direct-feed type writing implement includes:

a point assembly having a writing point at the tip thereof;

an ink tank directly storing a relatively low viscosity ink having a viscosity of 2 to 100 mPa.S at room temperature;

an ink collector for adjusting the internal pressure of the ink tank by utilizing capillarity;

a feeder means including a center core, for feeding ink from the ink tank to the writing point;

an ink absorber connected to the center core as the ink feeder means; and a duct pipe connecting the ink collector and the ink tank, and is characterized in that the ink absorber is provided inside the duct pipe and extended at least close to the ink tank bottom, the periphery of the ink absorber is covered by a non-absorbable skin with its front and rear ends open, the duct pipe has a length approximately equal to or greater than half the full length of the ink tank, and ink is supplied to the center core as the ink feeder means only through the ink absorber and the duct pipe.

DESCRIPTION OF THE PREFERRED EMBODIMENTS

Figure 1:
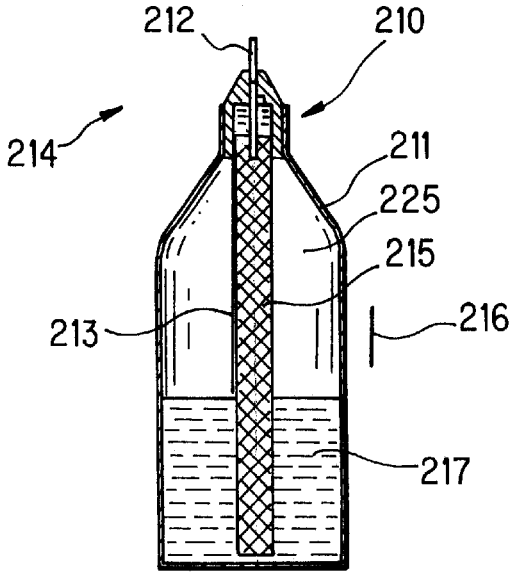
FIG. 1 PRIOR ART
FIG. 1 is a side sectional view showing a conventional applicator having a bottle-like liquid container set at its filling position.
Figure 2:
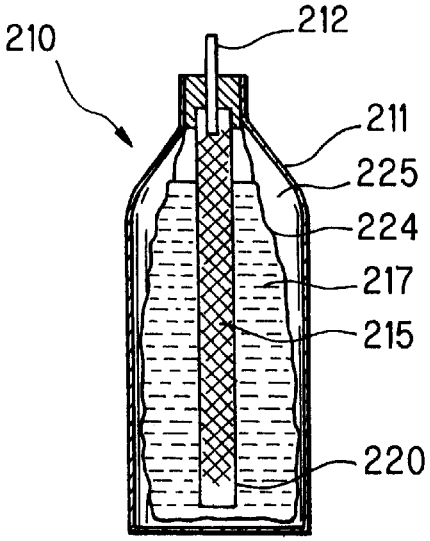
FIG. 2 PRIOR ART
FIG. 2 is a view showing a conventional applicator having a contractile liquid storage tube arranged in a liquid container and a valve means formed with a capillary liquid retainer, based on that shown in FIG. 1.
Figure 3:
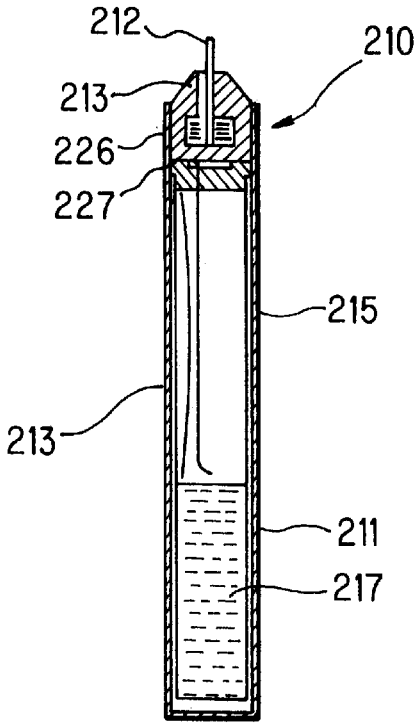
FIG. 3 PRIOR ART
FIG. 3 is a view showing a conventional applicator having an outer configuration different from that shown in FIG. 1.

The operations of the embodiments will hereinafter be described in detail with reference to the accompanying drawings.

To begin with, the means for achieving the present invention will be described. The ink used is a low (or medium) viscosity ink having a viscosity ranging from 2 to 100 Pa.S at room temperature (about 23° C. ). Alternatively, a pseudo-plastic ink (also to be referred to as gel ink) which presents a higher viscosity in its stationary state to prevent forward leakage of ink from the writing point and lowers its viscosity to permit smooth writing when the writing point is moved or stressed by shearing force during writing, may be used. As the solvent for the ink base, water, which is typical, may be used. Other than water, organic solvents such as lower alcohols, higher alcohols, xylene and the like, glycols such as ethylene glycol etc., and their esters which are applicable to ink for writing implements, may be used as appropriate.

The ink absorber used in the present invention may be of softly skinned and fixed, short or long fabric threads, as used conventionally, of a fiber bundle having long fabric threads shaped by adhesives or thermo-bonding without using any skin, of a plastic extrusion formed core having a snow-crystal section, of a sintered core made up of small particles with spaces or pores, thermally fixed or bonded with adhesives, or of a sponge, as long as it is capable of holding ink to a certain degree or more.

In the embodiments shown hereinbelow, the duct pipe supporter is formed between the duct and the barrel wall, it may of course be formed between the duct and ink collector. Alternatively, instead of providing a duct pipe supporter, the duct pipe may be directly fixed to the barrel or ink collector.

The barrel used in the present invention for storing ink is preferably a see-through one which allows the user to monitor the ink consumption because the ink used is of a direct-feed type. Therefore, it is preferred that the barrel is formed of polypropylene or the like which is transparent.

As one of the features of the present invention, ink supply to the center core or the like as the ink feeder means is only allowed through the ink absorber and duct pipe. There are various methods to prohibit ink supply to the center core or the like, as the ink feeder means, other than through the ink absorber and duct pipe. Specifically, the duct pipe may be bonded to or squeezed into the barrel, or the duct pipe and barrel may be integrally formed.

Here, 'prohibiting ink supply to the center core or the like, as the ink feeder means, other than through the ink absorber and duct pipe' includes not only the case where ink may be directly supplied to the center core etc., as the ink feeder means through the ink absorber and duct pipe, but also indicates the case where ink from the duct pipe or ink absorber may be once retained in an ink retainer and then this retained ink may be supplied to the feeder means such as a center core and the like.

Various shapes can be considered concerning the shape of the duct pipe, particularly the sectional shape, but a circular shape is preferred in view of ease of air and ink flow.

The ink absorber is preferably arranged so as to reach the bottom of the ink tank in order to consume the ink therein.

The ink feeder portion may be formed in any shape such as a projected or depressed shape as long as it can feed ink to the ink channel. In order to efficiently lead the ink from the ink absorber to the ink collector, the ink feeder portion is preferably put in contact with the ink absorber or the feeder core. It is further preferable that the ink feeder portion is formed in a projected shape when the ink absorber is covered by a skin so that the ink feeder portion comes into direct contact with the ink absorber under the skin.

Figure 5:
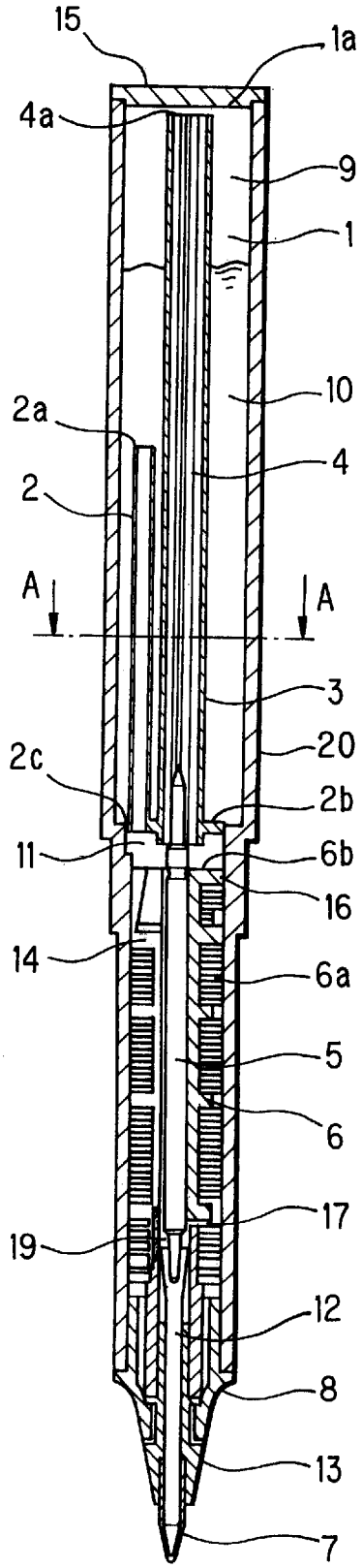
FIG. 5 is a vertical sectional view showing the overall configuration of a writing implement of the first embodiment of the present invention.
Figure 10:
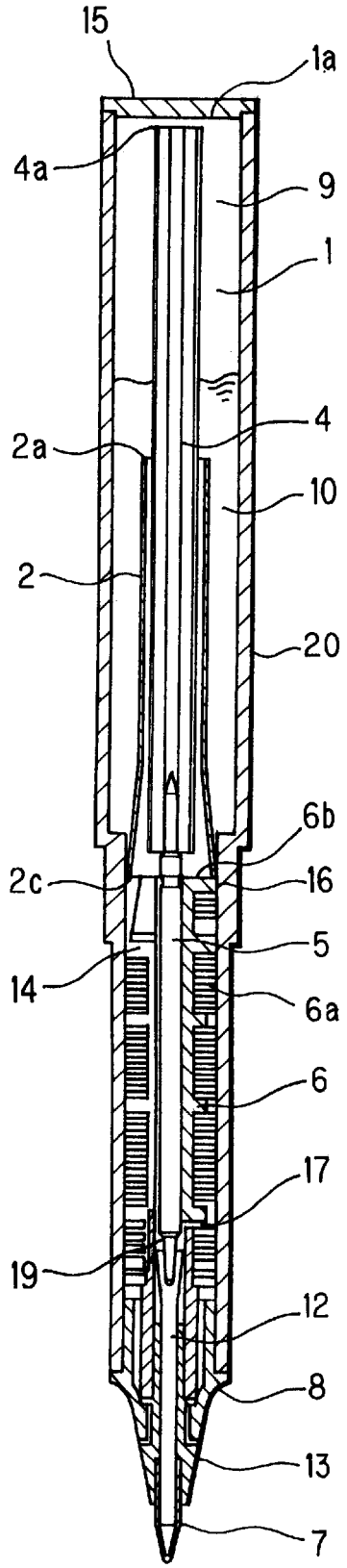
FIG. 10 is a vertical sectional view showing the overall configuration of a writing implement of the third embodiment of the present invention.

In the present invention, when an ink pool 11 is formed as shown in FIG. 5, for example, instead of a type shown in FIG. 10 where a duct pipe 2 is directly connected to an ink collector 6, the ink retention volume of duct pipe 2 is to be estimated including the volume of ink pool 11. Specifically, if there is an ink pool 11, the ink retention volume of duct pipe 2 is defined as the sum of the ink retention volume of the duct pipe itself and the ink pool volume.

Figure 4:
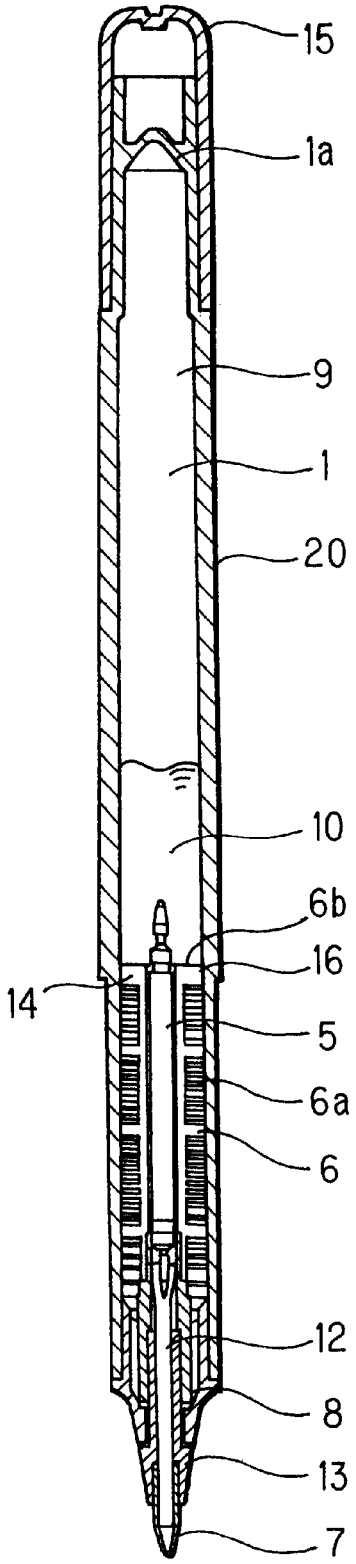
FIG. 4 PRIOR ART
FIG. 4 is a vertical sectional view showing the overall configuration of another conventional example of a writing implement.

Now, the illustrated embodiments will be further detailed. FIG. 4 shows the conventional embodiment, and the others show the embodiments of the present invention. FIG. 4 is a conventionally existing, water-based ball point pen UB-150, a product of MITSUBISHI PENCIL CO., LTD., having a vane-regulator type ink collector (ink retention volume of about 0.3 $cm^3$). As an example of an ink collector, a vane-regulator type ink collector will be described. However, ink collectors should not be limited to the vane-regulator type. The total volume of the ink contained in UB-150 is approximately 2.0 $cm^3$. In FIG. 4, reference numerals 8, 13 and 15 designate a plastic mouthpiece, joint and tail plug, respectively.

The requirements on the embodiments shown hereinbelow are to deal with the change in the temperature of the ink tank from about 20° C., the room temperature, to a warm temperature at about 50° C. In daily use circumstances, the temperature of the ink tank will reach 30 to 35° C. from the air temperature and the body temperature of the user of the writing implement. However, the temperature is considered to reach up to about 50° C. in some climatic situations in summer. Since the amount of ink blow-out becomes maximum at around this temperature, it was decided that the range of heating should be set at about 50° C. Ink, ink collector 6, ink feeder core 5 and other components of the UB-150 were used for evaluation.

With the conventional example shown in FIG. 4, when the ink has been consumed to a certain degree forming a large empty space 9 in ink tank 1 and when the amount of residual ink is greater than the retention volume of ink collector 6, the risk of ink blow-out will become maximum if the air inside the ink tank expands due to reduction in pressure and/or increase in temperature.

Specifically, suppose the ink retention volume of ink collector 6 is 0.3 $cm^3$ (0.3cc) and the amount of ink is 0.5 $cm^3$ while the volume of the space in ink tank 1 is about 1.5 $cm^3$, the risk of ink blow-out becomes high. That is, with the ink collector having a retention volume of 0.3 $cm^3$, the upper limit of the volume of ink tank 1 is about 2 $cm^3$.

Next, the present invention will be further detailed referring to the first to fifth embodiments.

With reference to FIGS. 7A to 7D and FIGS. 8A to 8D, the principle of prevention of ink blow-out and writing of the present invention will be described. FIGS. 7A to 7D are illustrative views showing the writing implement of the first embodiment shown in FIG. 5, and the four stages of the ink tank 1 state when the writing point 7 is set downwards. FIGS. 8A to 8D are illustrative views showing the writing implement of the first embodiment shown in FIG. 5 and the four stages of the ink tank 1 state the writing point 7 is set upwards. FIGS. 7A to 7D show the way ink is consumed, sequentially from FIG. 7A to FIG. 7D. FIGS. 8A to 8D are the same.

Figure 6:
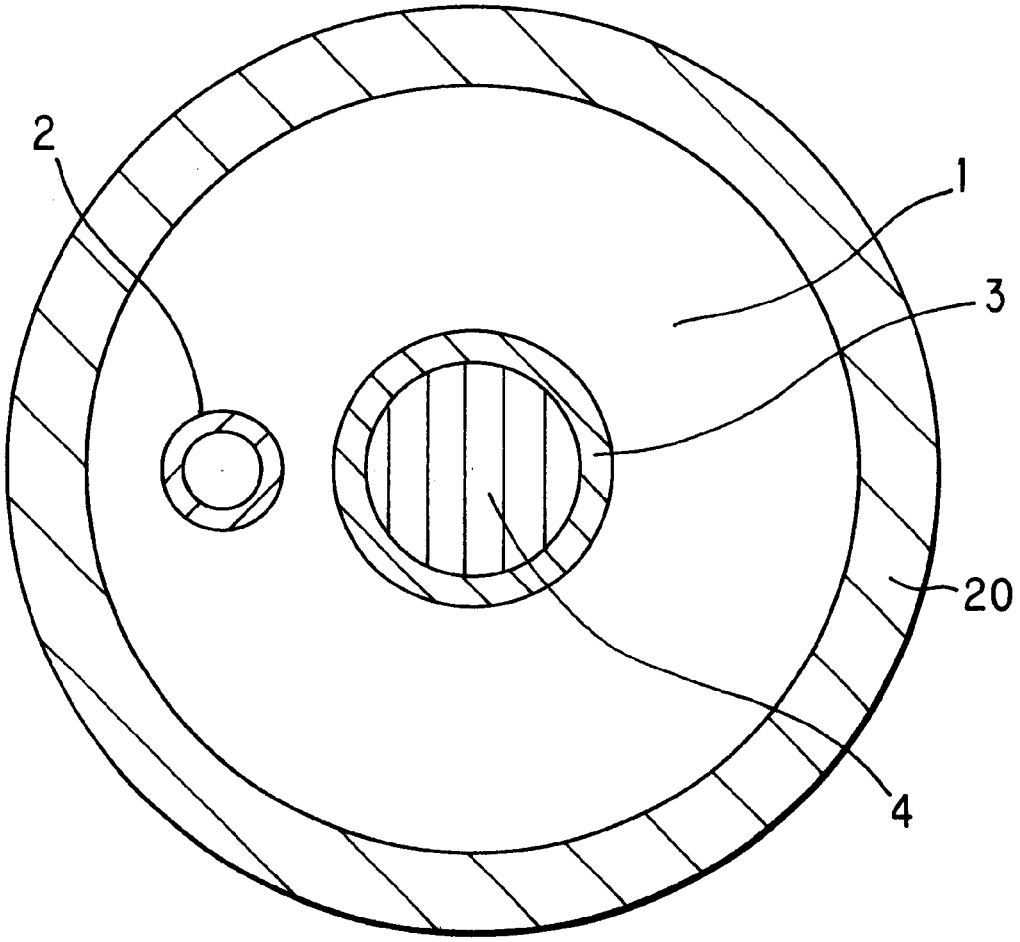
FIG. 6 is a sectional view cut along a plane A—A of FIG. 5.

Also as shown in FIG. 6, hollow duct pipe 2, ink absorber 4 and skin 3 are arranged inside the ink tank shown in FIG. 5. Ink 10 to feeder core 5, center core 12 and writing point 7 is supplied not only from absorber 4 but also through duct pipe 2.

Here, a point assembly comprises; a writing point 7, a center core 12, a joint 13, etc., wherein the writing point 7 may be of such types as a ball-point pen, felt pen, sintered core with point, and the like.

In any of the states shown in FIGS. 7A to 7D and FIGS. 8A to 8D, ink absorber 4 is enclosed by non-absorbable skin 3 made of polypropylene or the like. The connection between supporting member 2*b* of the pipe duct support 2*c* and skin 3 is completely sealed and the connection of pipe duct support member 2*b* with duct pipe 2 and barrel 20 is also completely sealed, so that ink supply to feeder core 5 is only from ink absorber 4 and duct pipe 2.

Figure 7A:
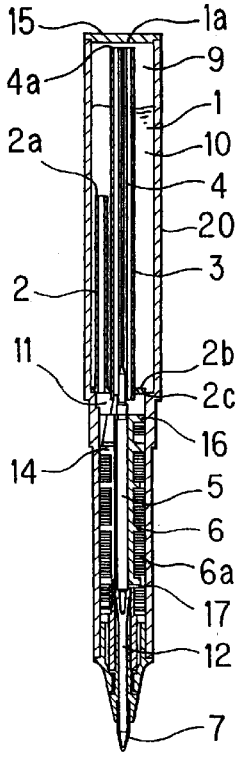
FIGS. 7A to 7D are illustrative views showing the writing implement of the first embodiment shown in FIG. 5 and the four stages of the ink tank state with its writing point set downwards.

FIGS. 7A to 7D are illustrative views showing the writing implement of the first embodiment shown in FIG. 5 and the four stages of the ink tank 1 state when the writing point 7 is set downwards. FIG. 7A shows the state where the liquid surface of the ink is above the duct pipe end 2*a*. In this case, ink for writing is supplied from the ink absorbed in ink absorber 4, the ink stored in duct pipe 2 and the ink existing higher than the duct pipe end 2*a*.

The principle of preventing ink blow-out in this case is as follows. When the surroundings of the pen body are affected by temperature rise, pressure drop or the like, empty space 9 in ink tank 1 starts expanding. As the air expands, the ink corresponding to the expansion enters ink collector 6 via duct pipe 2. Here, if ink in excess of the ink retention volume of ink collector 6 is supplied through duct pipe 2, ink blow-out will occur. Therefore, in order to effectively prevent ink blow-out when the ink surface is located above duct pipe end portion 2*a* with writing point 7 set downwards, it is necessary to limit the expansion of air space 9 when the surroundings are increased in temperature from room temperature to about 50° C., equal to or lower than the ink retention volume of ink collector 6.

In this case, ink can be supplied to writing point 7 via duct pipe 2 until the ink surface reaches the level of duct pipe end 2*a* since the level of the ink surface is higher than the duct pipe end 2*a*. Therefore, in this case, continuous ink supply is made possible without the necessity of turning the writing point upwards. Air replacement during writing in this case is performed through an ink channel (small channel) 14, so that air bubbles arising go up through duct pipe 2 to ink tank 1.

Figure 7B:
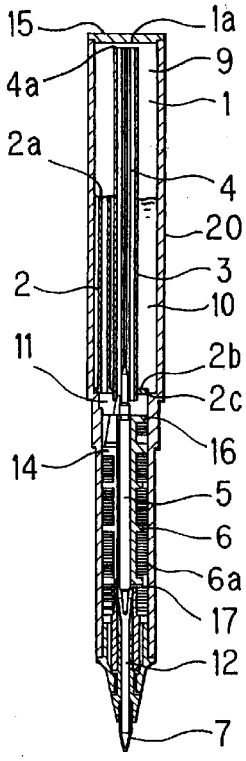
Figure 7C:
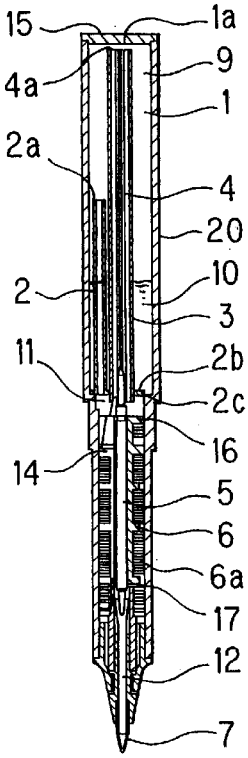
Figure 7D:
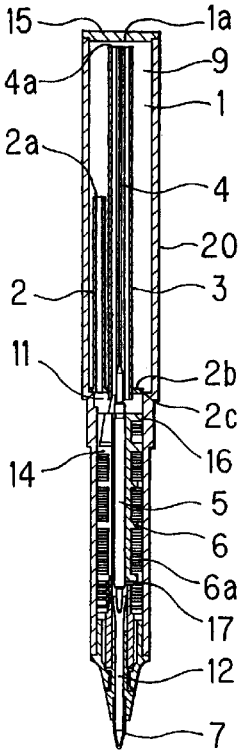

Next, suppose that the ink level in ink tank 1 is approximately equal to that of duct pipe end 2*a* as shown in FIG. 7B. In this case, if ink absorber 4 has a low porosity and hence has a high ink retaining capacity, ink can be retained in ink collector 6 in an amount approximately equal to that retained in duct pipe 2. Therefore, by specifying the amount of ink within duct pipe 2 at 0.3 $cm^3$ or lower, it is possible to prevent ink blow-out regardless of the amount of ink around skin 3 and duct pipe 2. The principle of blow-out prevention for the cases shown in FIGS. 7C and 7D is the same as that shown in FIG. 7B. When ink absorber 4 has a low porosity and hence has a high ink retaining capacity, ink can be retained in ink collector 6 in an amount approximately equal to that retained in duct pipe 2. Therefore, by specifying this amount at 0.3 $cm^3$ or lower, it is possible to prevent ink blow-out. Thus, when ink absorber 4 has a low porosity and hence has a high ink retaining capacity, the ink retention volume of the duct pipe needs to be designed to be equal to or lower than that of ink collector 6.

When ink absorber 4 has a high porosity and hence has a poor ink retaining capability, part of ink retained in ink absorber 4 may enter ink collector 6 when air Inside ink tank 1 expands. Therefore, it is preferred that the ink retention volume of duct pipe 2 should be reduced by taking into account the amount of ink entering ink collector 6 from ink absorber 4. Further, it is further preferred that the total ink retention volume of duct pipe 2 and ink absorber 4 should be equal to or lower than the ink retention volume of ink collector 6 in order to prevent ink blow-out more positively.

Ink supply for writing in this case is performed from the ink in ink absorber 4 and the ink held in duct pipe 2. Accordingly, it is possible to make the writing distance longer than the conventional configuration(Japanese Patent Application Laid-Open Hei 4 No. 227886), since ink is further supplied from duct pipe 2.

Next, with reference to FIGS. 8A to 8D, the principle of ink blow-out prevention when the writing point 7 is set upwards will be described. Similar to FIGS. 7A to 7D, FIGS. 8A to 8D show the way ink is consumed, sequentially from FIG. 8A to FIG. 8D.

Figure 8A:
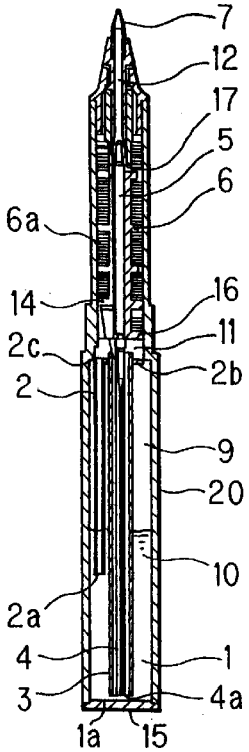
FIGS. 8A to 8D are illustrative views showing the writing implement of the first embodiment shown in FIG. 5 and the four stages of the ink tank state with its writing point set upwards.

First, in the case in FIG. 8A, if the pen is warmed or the pressure reduced, the air above the ink surface expands. Since this air has no way of escape, the volume of ink equivalent to that of air expansion is pushed up through duct pipe 2 and ink absorber 4 to enter ink collector 6. In this embodiment, the ink holding space above duct pipe end 2*a*(on the writing point 7 side) is designed to be about 2.2 $cm^3$, which is greater than the ink holding space below (on the ink tank bottom 1*a* side). For instance, the amount of ink above duct pipe end 2*a* is assumed to be 0.5 $cm^3$, the volume of the space is 1.7 $cm^3$. In this state, the pen is warmed up to about 50° C., the amount of air expansion is about 0.2$cm^3$. Also evaporation of ink should be taken into account. In this case, it is possible to prevent ink blow-out as long as the sum of the air expansion volume and the volume expansion due to ink evaporation is approximately equal to or even marginally greater than the retention volume of ink collector 6. Here, when the writing point is set upwards, the reason for being possible to prevent ink blow-out if the total expansion volume is approximately equal to or even marginally greater then the retention volume of ink collector 6 is owing to the fact that not only the gaps between ink collector vanes 6*a* but also the space or clearance between the wall of barrel 20 and ink collector 6 can be used and also that the gravity on the ink also produces resistance, as will be described later. When the pen is turned from this state so that the writing point is set downwards for writing, the pen is put in the same state as shown in FIG. 7A. Therefore, ink will be supplied based on the same principle as stated with reference to FIG. 7A.

Figure 8B:
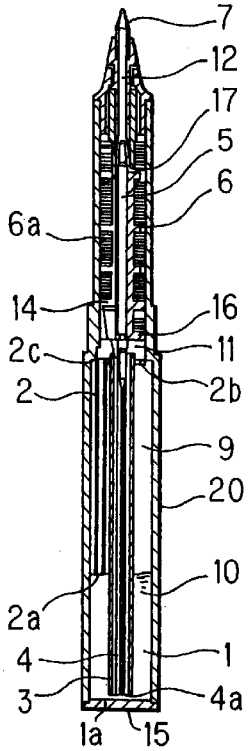

Next, the case in FIG. 8B will be described. In FIG. 8B, if the pen is affected by being warmed or pressure drop, the air space above the level of the duct pipe end 2*a* expands. In this case, ink in contact with the duct pipe end 2*a* enters ink collector 6 via duct pipe 2 but soon the level of the ink surface lowers proportionally to this ink entrance so the liquid surface will separate from the duct pipe end 2*a*. Then, in turn air comes into contact with duct pipe end 2*a*, and expanded air will be discharged out via ink channel 14 of ink collector 6 hence no more ink will enter ink collector 6. In this way, entrance of ink into ink collector 6 is very small, so no ink blow-out will occur.

Figure 8C:
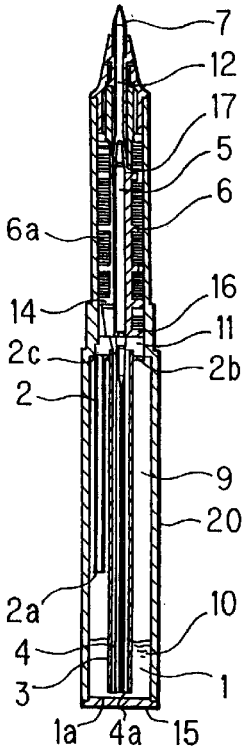

Further, when the ink in the ink tank has been consumed as shown in FIG. 8C so that the ink surface is totally separated from the duct pipe end 2*a*, only the expanded air due to being warmed and/or reduction in pressure escapes through duct pipe end 2*a* and pushes the ink slightly remaining within duct pipe 2 to ink collector 6. Thus, in this case no ink blow-out will occur.

Figure 8D:
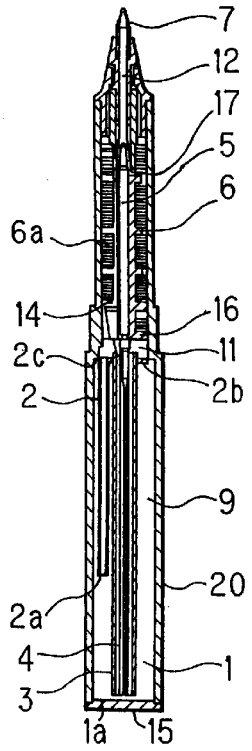

Finally, when the ink in the ink tank has been almost used up as shown in FIG. 8D, only the ink remaining within duct pipe 2 will enter ink collector 6. Also in this case, ink blow-out can be prevented as in the case of FIG. 8C. Therefore, in order to effectively prevent ink blow-out, it is necessary that the ink storage volume of duct pipe 2 should be approximately equal to or lower than the sum of the ink retention volume of the ink collector and the volume of the space or clearance formed between the barrel wall and the ink collector. Here, the principle of ink supply for writing is the same as that described with reference to FIGS. 7B to 7D.

In theory, if duct pipe 2 has half the length of ink tank 1, it will perform the necessary functions to achieve the above principle. In practice, however, since the amount of ink retained differs between when the pen is put with its writing point upwards and when it is put with its writing point downwards, it is preferred that the length of duct pipe 2 should be equal to or greater than half the length of the liquid ink storage part of ink tank 1. With the writing point put downwards, ink retention of ink collector 6 is achieved only by the gaps between ink collector vanes 6*a* in ink collector 6, whereas with the writing point placed upwards, ink is retained not only by the vanes but also by ink filling the clearance between the wall of barrel 20 and ink collector 6. That is, a greater amount of ink can be retained when the writing point is upwards than when the writing point is downwards. When the writing point is upwards, ink has to enter ink collector 6 opposing gravity, which provides resistance against the ink entrance into ink collector 6. Therefore, a more improved safety for blow-out prevention can be obtained when the writing point is upwards than when the writing point is downwards.

Further, since there is ink absorber 4 in ink tank 1, the space associated with air expansion in ink tank 1 is reduced by that volume, so that safety against blow-out can be further enhanced.

When, in FIGS. 7B to 7D, the ink within duct pipe 2 and ink absorber 4 is completely used up and it becomes impossible to write, it is necessary to supply ink to ink absorber 4 at the ink absorber end 4*a* or supply ink into duct pipe 2 by turning the pen upside down for a while so that writing point 7 is placed upwards. Accordingly, in order to completely consume the ink inside ink tank 1, it is preferred that ink absorber end 4*a* is arranged near the ink tank bottom or the length of ink absorber 4 is approximately equal to the length of ink tank 1, and/or a means for making ink readily enter duct pipe 2 is provided.

Ink absorber 4 is configured of a sliver, sponge etc. which is able to retain ink by capillary action.

Ink absorber 4 may not be covered totally by skin 3 but if it is covered from the writing point 7 side up to as high toward ink tank bottom la as duct pipe 2*a*, the blow-out prevention and the principle of ink supply for writing can be achieved.

Next, the embodiments shown in FIGS. 9 and 10 will be described. The principle of blow-out prevention and the principle of ink supply for writing are the same as in the first embodiment of FIG. 5.

Figure 9:
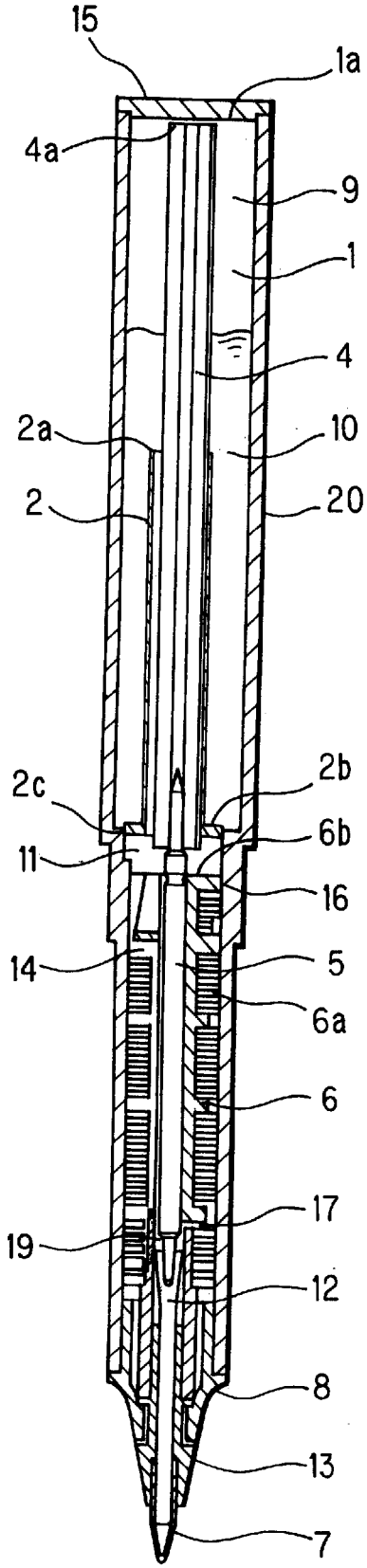
FIG. 9 is a vertical sectional view showing the overall configuration of a writing implement of the second embodiment of the present invention.

FIG. 9 shows the second embodiment of the present invention, in which an ink absorber 4 is arranged inside a duct pipe 2. This duct pipe 2 is set off or eccentric from the barrel center so that ink and air will pass through the clearance formed between the pipe wall and ink absorber 4. In this case, since ink absorber 4 is covered by duct pipe 2, the ink absorber 4 need not be necessarily covered with skin 3.

FIG. 10 shows the third embodiment of the present invention, in which a duct pipe 2 is provided the whole way round ink absorber 4. Also in this case, ink and air will pass through the clearance formed between the pipe wall and ink absorber 4. Since the outer side of the ink absorber is covered by duct pipe 2, the ink absorber 4 need not be necessarily covered with a skin. The third embodiment is the type of which duct pipe 2 is directly connected to an ink collector 6.

In both the second and third embodiments, it is necessary to seal between duct pipe 2 and the wall of a barrel 20 so that ink will not enter the center core etc., as the ink feeder means, other than through duct pipe 2 and ink absorber 4.

Figure 11:
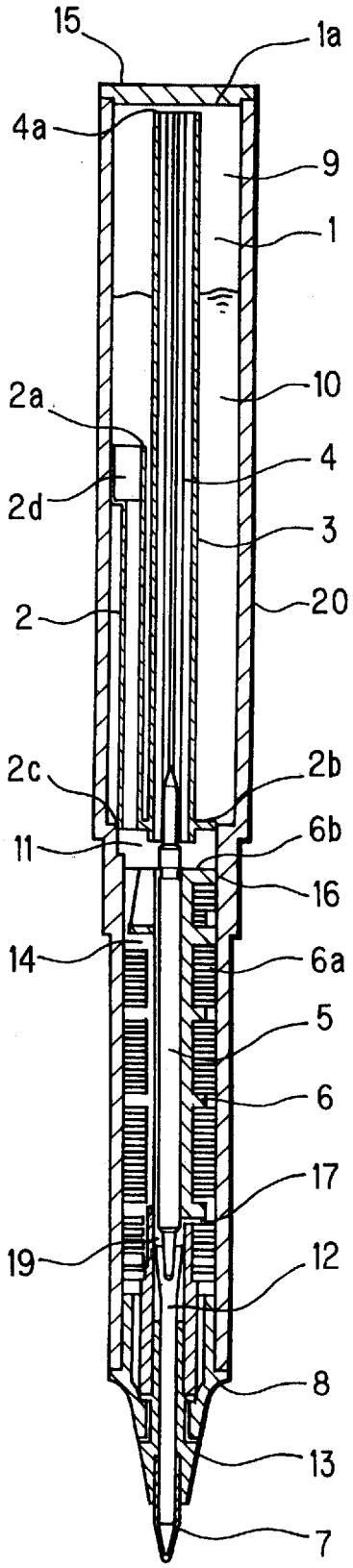
FIG. 11 is a vertical sectional view showing the overall configuration of a writing implement of the fourth embodiment of the present invention.

In the embodiments shown above, when the writing point is set downwards and if the ink surface is equal to or lower than the position of duct pipe end 2*a*, it is difficult to supply ink to duct pipe 2. FIG. 11 shows the fourth embodiment of the present invention, which makes ink supply to duct pipe 2 easy. Once the writing point is turned upwards and again turned downwards, ink gathers into a duct pipe ink receiver 2*d*, flowing along the wall surface of ink tank 1, to enable ink supply to duct pipe 2. In order to positively collect ink to this duct pipe ink receiver 2*d*, it is preferred that ribs or the like for leading ink are formed on the ink tank interior wall.

In the fourth embodiment shown in FIG. 11, though ink receiver 2*d* only comes in partial contact with ink tank 1, the shape of ink receiver 2*d* can be designed as appropriate as long as it can collect ink.

In each of the above embodiments, one or more small holes 17 are preferably formed between ink collector vanes 6*a* on ink collector 6 so as to establish communication between the collector and a communication passage 19 through which ink feeder means 5 and 12 such as feeder core etc., penetrate. For instance, in the situations shown in FIG. 7C and FIG. 7D, air expanded by being warmed and/or reduction in pressure is discharged out via duct pipe 2. When the rate of being warmed or the rate of reduction in pressure is too low, the air in ink tank 1 expands very slowly. In this case, it is difficult for the slowly expanding air to break the meniscus of the ink formed on a sealing surface 16 of ink collector 6. In this case, instead of discharging air outside, the ink retained in ink absorber 4 equivalent to the volume of air expansion will be discharged out from the writing point by way of feeder core 5. As a result, forward leakage that causes ink blobbing from writing point 7 occurs staining clothes and the like. If small holes 17 are provided, the ink having passed through feeder core 5 will enter the sites between ink collector vanes 6*a* through the small holes 17. In a so-called ball-point pen having writing point 7 as above, since the ball itself serves as a plug and since capillarity arises between ink collector vanes 6*a*, ink will not flow to the writing point but flows to small holes 17, never causing forward leakage.

Figure 12:
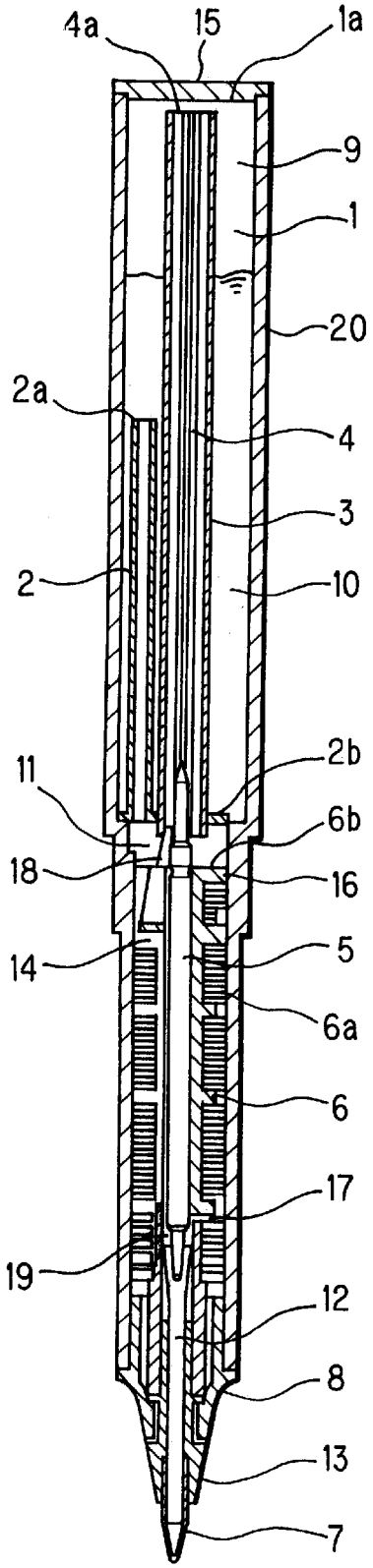
FIG. 12 is a vertical sectional view showing the overall configuration of a writing implement of the fifth embodiment of the present invention.
Figure 13:
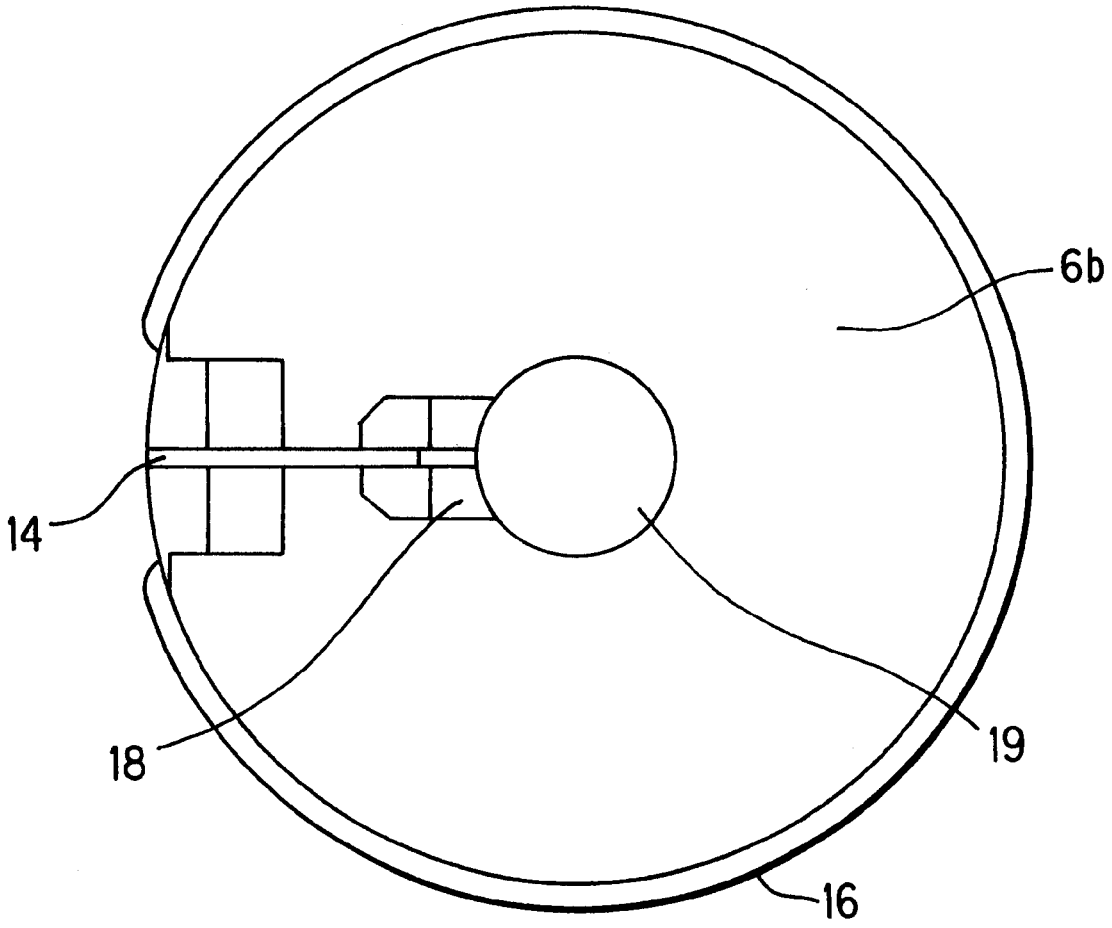
FIG. 13 is a plan view showing an ink collector of the fifth embodiment shown in FIG. 12.

In order to achieve further improved prevention against forward leakage, it is effective to provide an ink feeder portion 18 according to the fifth embodiment shown in FIGS. 12 and 13. This ink feeder portion 18 In the fifth embodiment is formed with a slit of 0.05 to 0.3 mm wide defined by two plate-like elements and is directly connected to the Ink collector end face, designated at 6*b*. Also in this case, with the pen in the state shown in FIG. 7C or 7D, if air expands due to being warmed or reduction in pressure, the expanded air passes through duct pipe 2 to be discharged outside. If air is slowly warmed or reduced in pressure, the air in ink tank 1 expands very slowly. In such a case, it is very difficult for the slowly expanding air to break the ink meniscus created on sealing surface 16 of ink collector 6. Resultantly, there occurs high possibility that ink impregnated in ink absorber 4, up to the amount corresponding to the volume of air expanded inside ink tank 1, might leak forwards through feeder core 5 and center core 12. In this case, however, ink feeder portion 18 presents capillarity because of its sufficiently small slit width, so that the ink being impregnated in ink absorber 4 is introduced by this ink feeder portion 18 into ink collector 6, thus making it possible to reduce forward leakage toward writing point 7. In this way, provision of ink feeder portion 18 may reduce forward leakage.

The total storage amount of ink in the embodiments shown in FIG. 5 and FIGS. 7A to 7D to FIG. 12 is approximately 3.5 $cm^3$ while the ink retention volume of ink collector 6 is about 0.3 $cm^3$ as in the conventional example UB-150. Therefore, compared to the ink volume of 2.0 $cm^3$ of the conventional direct-feed type writing implement, the total storage amount of ink increases to 1.75 times with the same retention volume of ink collector 6. This means that a direct-feed type writing implement of the same volume of ink tank 1 can be provided using a smaller ink collector 6 than the conventional one. Alternatively, if an ink collector 6 of the same size as conventional is used, it is possible to provide a direct-feed type writing implement capable of keeping a greater amount of ink.

In any of the above embodiments, owing to the above principle of blow-out prevention and writing, ink tank 1 can be charged full of ink, compared to the conventional example(Japanese Patent Application Lald-Open Hei 4 No. 227886), where ink can be charged to the ink tank only up to half-full. In the practical assembly etc., in order to prevent ink from overflowing during assembly or for other purposes, ink may be charged to the ink tank, not to the full level but leaving some air.

Further, ink can be supplied from duct pipe 2 to ink channel(small channel) 14 functioning as the air-liquid exchanger of ink collector 6. As a result, it is possible to wet the air-liquid exchanger of ink collector 6, thus making it possible to suppress occurrence of forward leakage, which was the problem in the conventional example. Further, provision of ink feeder portion 18 assures reliable ink supply to ink channel (small channel) 14 as the air-liquid exchanger, so that it is possible to positively wet the ink channel, hence enhance the prevention against forward leakage.

Figure 14:
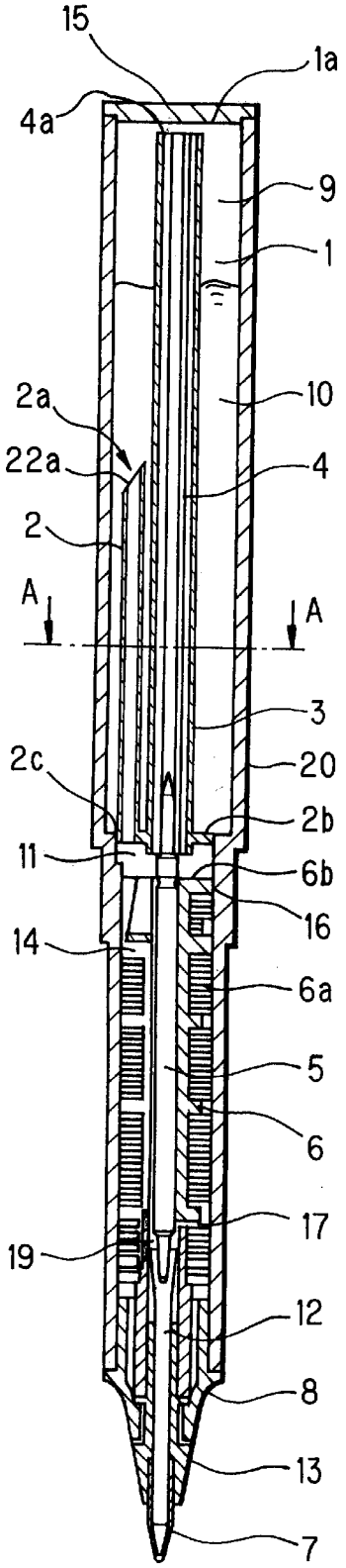
FIG. 14 is a vertical sectional view showing a variational example of the first embodiment shown in FIG. 5.

FIG. 14 shows a variational example of the first embodiment of the present invention, the end part 2*a* of duct pipe 2 is shaped into a beveled facet 22*a*. With reference to this figure, as ink is consumed by writing, air bubbles arise at ink channel 14 and go up along duct pipe 2 and reach end part 2*a* of duct pipe 2, where the bubbles are released to the ink tank. Since the presence of beveled facet 22*a* makes air bubbles readily separate from end part 2*a* of the duct pipe, it is possible to prevent adverse effects on the writing performance due to air bubbles failing to separate and remaining inside duct pipe 2. Although not shown, it is understood that the same effect can be expected by beveling the duct pipe in each of the other configurations.

As has been described heretofore, the present invention is configured as above. That is, if the volume of the ink tank is the same, it is possible to provide a direct-feed type writing implement using a smaller ink collector than that used in the conventional configuration. If an ink collector of the same size is used, it is possible to provide a direct-feed type writing implement capable of holding a greater amount of ink. Use of an ink collector smaller than the conventional configuration makes the appearance of the writing implement stylish. Further, the present invention has the advantages of low cost for forming and ease of forming over and above the conventional configuration.

When, with its writing point downwards, the ink level is higher than the duct pipe end, ink can be continuously supplied via the duct pipe. When the ink level is lower than the duct pipe end, ink held in the ink absorber and in the duct pipe can be delivered. Therefore, it is possible to provide a direct-feed type writing implement which can deliver ink to greater writing distance than the existing writing implements.

Further, it is possible to provide a direct-feed type writing implement in which forward leakage which would occur accompanying the communication with the atmosphere via the opening of the air supply pipe is prevented.

Finally, it is possible to provide a direct-feed type writing implement capable of fully charging the entire ink tank, which was impossible in the conventional example(Japanese Patent Application Laid-Open Hei 4 No. 227886).

What is claimed is:

1. A direct-feed type writing implement comprising:

a point assembly having a writing point at the tip thereof;

an ink tank directly storing a relatively low viscosity ink having a viscosity of 2 to 100 mPa.S at room temperature;

an ink collector for adjusting the internal pressure in the ink tank by utilizing capillarity;

a feeder means including a center core, for feeding the ink from the ink tank to the writing point;

an ink absorber connected to the center core as the ink feeder means; and a duct pipe connecting the ink collector and the ink tank.

2. The direct-feed type writing implement according to claim 1, wherein the duct pipe is formed with an ink storage portion.

3. The direct-feed type writing implement according to claim 1, wherein the ink absorber is arranged inside the duct pipe.

4. The direct-feed type writing implement according to claim 1, wherein the periphery of the ink absorber is covered by a non-absorbable skin with its front and rear ends open.

5. The direct-feed type writing implement according to claim 1, wherein the ink absorber is disposed at least close to the ink tank bottom.

6. The direct-feed type writing implement according to claim 1, wherein the duct pipe has a length approximately equal to or greater than half the full length of the ink tank.

7. The direct-feed type writing implement according to claim 1, wherein the ink collector is provided with an ink channel forming an air-liquid exchanger, and an ink feeder portion for leading ink to the ink channel is formed on the ink collector end face on the ink tank side.

8. The direct-feed type writing implement according to claim 1, wherein a hole is formed in a communication passage for creating communication between the ink collector for adjusting the internal pressure in the ink tank by utilizing capillarity.

9. The direct-feed type writing implement according to claim 1, wherein, when the level of ink is above an end portion of the duct pipe with the writing point set downwards, the expansion of an air space when the temperature of the ink tank is increased from room temperature to about 50° C., is equal to or lower than the ink retention volume of the ink collector.

10. The direct-feed type writing implement according to claim 1, wherein, when the level of ink is above an end of the duct pipe with the writing point set upwards, the expansion of an air space when the temperature of the ink tank is increased from room temperature to about 500° C., is equal to or lower than the sum of the ink retention volume of the ink collector and the volume of a clearance formed between a barrel wall and the ink collector.

11. The direct-feed type writing implement according to claim 1, wherein the ink retention volume of the duct pipe is equal to or lower than the ink retention volume of the ink collector.

12. The direct-feed type writing implement according to claim 1, wherein the total ink retention volume of the duct pipe and the ink absorber is equal to or lower than the ink retention volume of the ink collector.

13. The direct-feed type writing implement according to claim 1, wherein the ink tank is charged with ink until almost full.

14. The direct-feed type writing implement according to claim 1, wherein an end portion of the duct pipe is beveled.

15. A direct-feed type writing implement comprising:

a point assembly having a writing point at the tip thereof;

an ink tank directly storing a relatively low viscosity ink having a viscosity of 2 to 100 mPa.S at room temperature;

an ink collector for adjusting the internal pressure of the ink tank by utilizing capillarity;

a feeder means including a center core, for feeding the ink from the ink tank to the writing point;

an ink absorber connected to the center core as the ink feeder means; and a duct pipe connecting the ink collector and the ink tank, characterized in that the ink is supplied to the center core as the ink feeder means only through the ink absorber and the duct pipe.

16. The direct-feed type writing implement according to claim 15, wherein the duct pipe is formed with an ink storage portion.

17. The direct-feed type writing implement according to claim 15, wherein the ink absorber is arranged inside the duct pipe.

18. The direct-feed type writing implement according to claim 15, wherein the periphery of the ink absorber is covered by a non-absorbable skin with its front and rear ends open.

19. The direct-feed type writing implement according to claim 15, wherein the ink absorber is disposed at least close to the ink tank bottom.

20. The direct-feed type writing implement according to claim 15, wherein the duct pipe has a length approximately equal to or greater than half the full length of the ink tank.

21. The direct-feed type writing implement according to claim 15, wherein the ink collector is provided with an ink channel forming an air-liquid exchanger, and an ink feeder portion for leading ink to the ink channel is formed on the ink collector end face on the ink tank side.

22. The direct-feed type writing implement according to claim 15, wherein a hole is formed in a communication passage for creating communication between the ink collector for adjusting the internal pressure in the ink tank by utilizing capillarity.

23. The direct-feed type writing implement according to claim 15, wherein, when the level of ink is above an end portion of the duct pipe with the writing point set downwards, the expansion of an air space when the temperature of the ink tank is increased from room temperature to about 50° C., is equal to or lower than the ink retention volume of the ink collector.

24. The direct-feed type writing implement according to claim 15, wherein, when the level of ink is above an end of the duct pipe with the writing point set upwards, the expansion of an air space when the temperature of the ink tank is increased from room temperature to about 500° C., is equal to or lower than the sum of the ink retention volume of the ink collector and the volume of a clearance formed between a barrel wall and the ink collector.

25. The direct-feed type writing implement according to claim 15, wherein the ink retention volume of the duct pipe is equal to or lower than the ink retention volume of the ink collector.

26. The direct-feed type writing implement according to claim 15, wherein the total ink retention volume of the duct pipe and the ink absorber is equal to or lower than the ink retention volume of the ink collector.

27. The direct-feed type writing implement according to claim 15, wherein the ink tank is charged with ink until almost full.

28. The direct-feed type writing implement according to claim 15, wherein an end portion of the duct pipe is beveled.

29. A direct-feed type writing implement comprising:

a point assembly having a writing point at the tip thereof;

an ink tank directly storing a relatively low viscosity ink having a viscosity of 2 to 100 mPa.S at room temperature;

an ink collector for adjusting the internal pressure of the ink tank by utilizing capillarity;

a feeder means including a center core, for feeding the ink from the ink tank to the writing point;

an ink absorber connected to the center core as the ink feeder means; and a duct pipe connecting the ink collector and the ink tank, characterized in that the ink absorber is provided inside the duct pipe and extended at least close to the ink tank bottom, the periphery of the ink absorber is covered by a non-absorbable skin with its front and rear ends open, the duct pipe has a length approximately equal to or greater than half the full length of the ink tank, and the ink is supplied to the center core as the ink feeder means only through the ink absorber and the duct pipe.

* * * * *

UNITED STATES PATENT AND TRADEMARK OFFICE

CERTIFICATE OF CORRECTION

PATENT NO. : 6,302,610 B2
DATED : October 16, 2001
INVENTOR(S) : Yosuke Mito and Kazuhiko Furukawa It is certified that error appears in the above-identified patent and that said Letters Patent is hereby corrected as shown below:

Title page,
Item [73], Inventors, change "Kouza-gun (JP)" to -- Kanagawa, (JP) --

Signed and Sealed this

Twentieth Day of August, 2002

*Attest:*

*Attesting Officer*

JAMES E. ROGAN
*Director of the United States Patent and Trademark Office*